US008317939B2

(12) United States Patent
Tachisato

(10) Patent No.: US 8,317,939 B2
(45) Date of Patent: Nov. 27, 2012

(54) METHOD OF GAS CARBURIZING

(75) Inventor: Showa Tachisato, Yamatokoriyama (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 582 days.

(21) Appl. No.: 10/838,747

(22) Filed: May 4, 2004

(65) Prior Publication Data

US 2004/0250922 A1 Dec. 16, 2004

(30) Foreign Application Priority Data

Jun. 12, 2003 (WO) ..... PCT/JP03/07450

(51) Int. Cl.
*C23C 8/22* (2006.01)

(52) U.S. Cl. ..... 148/225

(58) Field of Classification Search ..... 148/206, 148/225

See application file for complete search history.

(56) References Cited

U.S. PATENT DOCUMENTS

| | | | | |
|---|---|---|---|---|
| 2,012,165 | A | 8/1935 | Hansen et al. | |
| 4,145,232 | A * | 3/1979 | Solomon | 148/218 |
| 6,106,636 | A | 8/2000 | Naito et al. | |
| 6,309,475 | B1 * | 10/2001 | Takayama et al. | 148/232 |

FOREIGN PATENT DOCUMENTS

| | | |
|---|---|---|
| JP | 1994-45868 | 6/1994 |
| JP | 6-192815 | 7/1994 |
| JP | 9-59756 | 3/1997 |
| JP | 10-121128 | 5/1998 |
| JP | 11-36060 | 2/1999 |
| JP | 11-200009 | 7/1999 |
| JP | 2000-129418 | 5/2000 |
| JP | 2001-81543 | 3/2001 |
| JP | 2001-214255 | 8/2001 |
| JP | 2003-147506 | 5/2003 |

OTHER PUBLICATIONS

ASM Handbook vol. 4, pp. 312-324 (1991).*
May 1, 2000 "Engineering Concepts" by Dave VanAken.
Investigation of High-Temperature Carburizing of Steel in Solid Carburizer With High-Frequency Heating, Metallov, Aug. 1959, pp. 32-38 Yur'ev et al.
U.S. Appl. No. 10/487,398, filed Feb. 19, 2004, Showa Tachisato.

* cited by examiner

*Primary Examiner* — Jessee R. Roe
(74) *Attorney, Agent, or Firm* — Jordan and Hamburg LLP

(57) ABSTRACT

In a first step of a method of gas carburizing, a steel treatment object is heated in a carburizing atmosphere comprising a carburizing gas until the surface carbon concentration of the treatment object reaches the final target value that is not higher than the solid solubility limit at a carburizing temperature that is not higher than the peritectic point, at which steel transforms from δ iron and liquid phase to γ iron, and is not less than the eutectic point, at which steel transforms from liquid phase to γ iron and cementite. In a second step the gas carburizing is advanced after the first step so that the carburizing depth of the treatment object increases while the surface carbon concentration of the treatment object is kept at the final target value by reducing the carbon potential of the carburizing gas with the lapse of time.

13 Claims, 7 Drawing Sheets

METHOD OF GAS CARBURIZING

FIELD OF THE INVENTION

The present invention relates to a method of gas carburizing used, for example, for modifying metal parts in the automotive industry and industrial machinery industry.

RELATED ART

Conventionally, the carburizing temperature established during the gas carburizing of a steel treatment object has been kept below the eutectic point (the C-point temperature in the iron-carbon equilibrium diagram shown in FIG. 1, for example, 1,147° C.) at which transformation occurs from a liquid phase to γ iron and cementite. However, when the carburizing temperature is limited to a value less the eutectic point, the carburizing time cannot be shortened because the carbon atoms in the austenite diffuse at a low flux, and long time is required to increase the carburizing depth from the surface of the treatment object.

In view of the above, it may be considered to increase the diffusion flux of the carbon atoms in the austenite in order to shorten the carburizing time by setting the carburizing temperature to a value not less than the eutectic point.

However, even if the carburizing temperature is set to the value that is not less than the eutectic point, it is difficult to further shorten the carburizing time because long time is required until the surface carbon concentration of the treatment object reaches a target value.

An object of the present invention is to provide a method of gas carburizing that solves the above-described problem.

SUMMARY OF THE INVENTION

When the carburizing temperature and carbon potential of the carburizing gas are kept constant, long time is required for the carburizing depth to reach a target value if the carbon potential is low, or the treatment object melts because the surface carbon concentration of the treatment object exceeds the solid solubility limit before the carburizing depth reaches the target value if the carbon potential is excessively high. As a result, when the carburizing temperature and carbon potential of the carburizing gas are kept constant, the carburizing time cannot be shortened so as to be less than the time required for the surface carbon concentration of the treatment object to reach the solid solubility limit (to reach the line JE in FIG. 1, for example). In contrast, the present invention shortens the time required for the carburizing process on the basis of a novel relationship between the carbon potential of the carburizing gas, the carburizing time, and the surface carbon concentration of the treatment object.

The method of gas carburizing according to the present invention comprises a first step in which a steel treatment object is heated in a carburizing atmosphere comprising a carburizing gas until the surface carbon concentration of the treatment object reaches a final target value that is not higher than the solid solubility limit at a carburizing temperature that is not higher than the peritectic point (point J in FIG. 1, for example), at which steel transforms from δ iron and liquid phase to γ iron, and is not less than the eutectic point, at which steel transforms from liquid phase to γ iron and cementite; and a second step in which gas carburization is advanced after the first step so that the carburizing depth of the treatment object increases while the surface carbon concentration of the treatment object is kept at the final target value by reducing the carbon potential (equilibrium carbon concentration) of the carburizing gas with the lapse of time. The gas carburizing temperature in the second step is preferably set to a value that is not higher than the peritectic point and not less than the eutectic point. According to the present invention, the surface carbon concentration of the treatment object is reached to a final target value that is not higher than the solid solubility limit in the first step, and the carburizing depth is increased while the carbon potential of the carburizing gas is reduced with the lapse of time in the second step. Hence, the surface carbon concentration of the treatment object can be reached to the final target value in a short period of time in the first step, and the carburizing depth can be increased in a short period of time without melting the treatment object in the second step.

Preferably, the relationship between time and the carbon potential of the carburizing gas is predetermined, in which the relationship is required for keeping the surface carbon concentration of the treatment object at the final target value while the carburizing temperature is kept at a constant value; and the carbon potential of the carburizing gas is changed with respect to time so as to satisfy the predetermined relationship while the carburizing temperature is kept at the constant value in the second step. If the carburizing temperature is constant, then the diffusion flux of the carbon atoms at the surface of the treatment object is proportional to the difference that is determined by subtracting the surface carbon concentration of the treatment object from the carbon potential of the carburizing gas. Hence, in the second step wherein the carburizing temperature is constant, the relationship between time and the carbon potential required for keeping the surface carbon concentration of the treatment object at the final target value can be determined, by determining the relationship between time and the diffusion flux of the carbon atoms when the surface carbon concentration of the treatment object is at the final target value. The carburizing time in the second step can be obtained by predetermining the time required to achieve a desired carburizing depth by experimenting.

Preferably, the relationship between the carbon potential of the carburizing gas, the carburizing temperature, and the carburizing time until the surface carbon concentration of the treatment object reaches the final target value is predetermined; the carbon potential of the carburizing gas, the carburizing temperature, and the carburizing time until the surface carbon concentration of the treatment object reaches the final target value are set so as to satisfy the predetermined relationship in the first step; and the carburizing temperature and the carbon potential of the carburizing gas are kept constant in the first step, the constant carburizing temperature in the second step is kept equal to the constant carburizing temperature in the first step, and the initial carbon potential of the carburizing gas in the second step is set equal to the constant carbon potential in the first step. The first and second steps can thereby be performed consecutively, and the carburizing treatment can be automated.

The final target value of the surface carbon concentration of the treatment object is preferably set in order to correspond to the solid solubility limit of the carbon at the surface of the treatment object. The carburizing time can thereby be minimized. In this case, the final target value is not required to perfectly correspond to the solid solubility limit, and can be less than the solid solubility limit, that is, it may correspond to the solid solubility limit as much as possible depending on the controllability of the surface carbon concentration of the treatment object.

According to the present invention, the consumption of gas and energy required for gas carburizing can be reduced by shortening the carburizing time.

DETAILED DESCRIPTION OF THE PREFERRED EMBODIMENT

Figure 2:
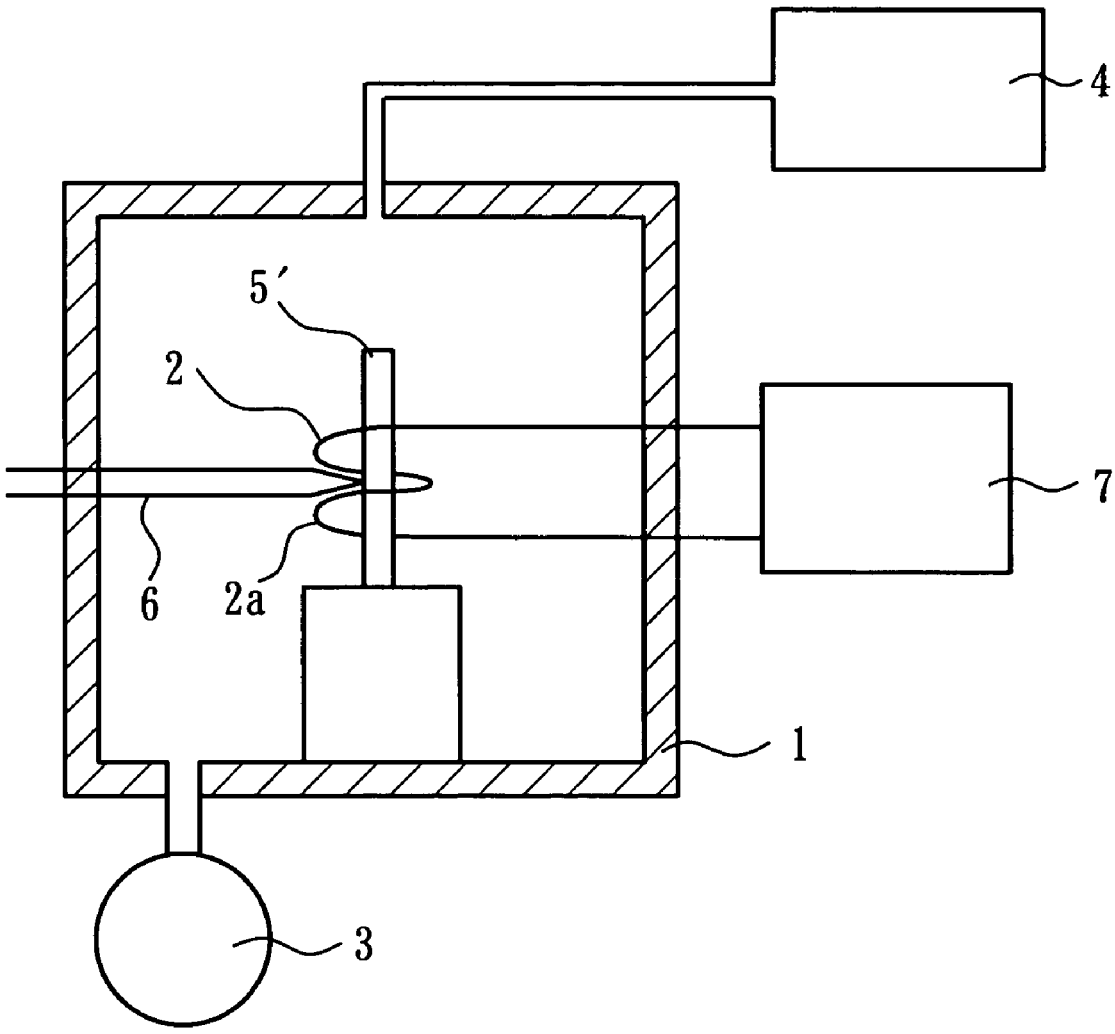
FIG. 2 is a diagram showing a state in which a sample of a treatment object is heated by a gas carburizing apparatus in an embodiment of the present invention.

FIG. 2 shows a gas carburizing apparatus used in an embodiment of the present invention. The gas carburizing apparatus comprises a vacuum container 1, a heating device 2, a vacuum pump 3 for reducing the pressure within the vacuum container 1, and a gas source 4 for supplying gas for carburizing atmosphere within the vacuum container 1. In the present embodiment, the heating device 2 carries out induction heating in the vacuum container 1 by means of a coil 2*a* connected to a power source 7. The output from the power source 7 to the coil 2*a* is variable.

Prior to gas carburizing a steel treatment object, a sample 5' of the steel treatment object is gas carburized. To complete this step, a thermocouple 6 is welded as a temperature-detecting sensor to the surface of the sample 5' in the heating device 2. The temperature-detecting means is not limited to a thermocouple. Then, the pressure within the vacuum container 1 is reduced by exhausting the air within the vacuum container 1 by means of the vacuum pump 3, and the pressure within the vacuum container 1 at this point is preferably set to about 27 Pa or less. After the pressure is reduced, the gas for the carburizing atmosphere is introduced from the gas source 4 into the vacuum container 1. The vacuum container 1 is thereby filled with the carburizing atmosphere, and the total pressure of the carburizing atmosphere is increased. The pressure of the carburizing atmosphere within the vacuum container 1 is raised to 80 kPa, for example. The gas for the carburizing atmosphere of the present embodiment is composed of carburizing gas and dilute gas. The types of the carburizing gas and dilute gas are not particularly limited. The carburizing gas of the present embodiment is methane gas, and the dilute gas is nitrogen gas. Nonoxidizing carburizing can be realized by using hydrocarbon-based gas as the carburizing gas. The carburizing gas is not limited to hydrocarbon-based gas. The carburizing atmosphere may partially contain the carburizing gas, or it may be composed only of the carburizing gas.

When the total pressure of the carburizing atmosphere within the vacuum container 1 is kept constant, gas for the carburizing atmosphere is fed from the gas source 4 into the vacuum container 1 at a constant flow rate and the carburizing atmosphere is exhausted at a constant flow rate by means of the vacuum pump 3. As a result, the gas for the carburizing atmosphere within the vacuum container 1 flows at a constant flow rate of e.g. 0.5 L/min and the total pressure of the carburizing atmosphere is kept at about e.g. 80 kPa. In other words, the carburizing atmosphere comprising the carburizing gas at a constant partial pressure flows within the vacuum container 1. The partial pressure of the carburizing gas is a value obtained by multiplying the total pressure of the carburizing atmosphere within the vacuum container 1 by the molar fraction or the volume percentage of the carburizing gas, and corresponds to the carbon potential of the carburizing gas. The concentration of the carburizing gas (vol %) that corresponds to the carbon potential of the carburizing gas can be varied by varying the total pressure of the carburizing atmosphere within the vacuum container 1 or by varying the flow rate ratio between the carburizing gas and dilute gas.

The sample 5' is heated to a set carburizing temperature by the heating device 2. The carburizing temperature is set to a value that is not higher than the peritectic point, at which steel transforms from δ iron and liquid phase to γ iron, and is not less than the eutectic point, at which steel transforms from a liquid phase to γ iron and cementite. The established value of the carburizing temperature can be adjusted by varying the output of the heating device 2 to the coil 2*a*.

Figure 3:
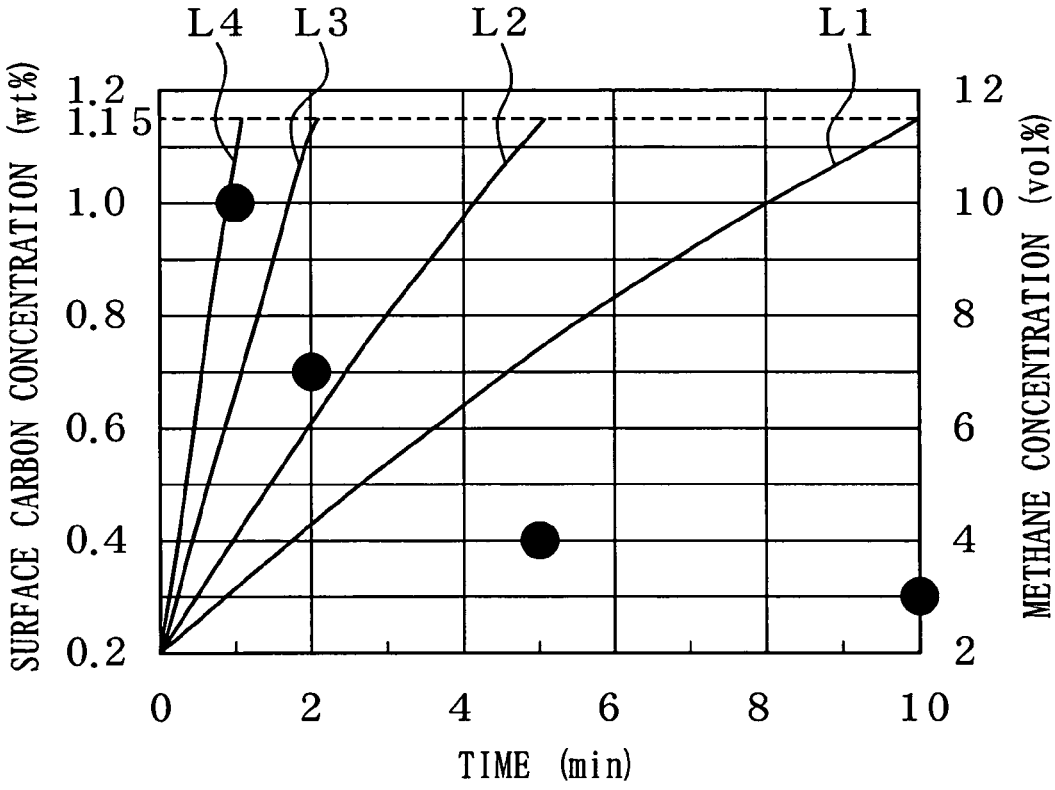
FIG. 3 is a diagram showing a relationship between the carburizing gas concentration, the surface carbon concentration, and the carburizing time until the surface of the treatment object starts to melt at a carburizing temperature of 1,300° C. in the embodiment of the present invention.

The carburizing time until just before the melting of the surface of the sample 5', that is to say, the carburizing time until the surface carbon concentration of the treatment object reaches the solid solubility limit, is predetermined in a preset carburizing temperature and a preset carbon potential of the carburizing gas. In the present embodiment, the final target value of the surface carbon concentration of the treatment object corresponds to the solid solubility limit of the carbon at the surface of the treatment object. The relationship between the carbon potential of the carburizing gas, the carburizing temperature, and the carburizing time until the surface carbon concentration of the treatment object reaches the final target value is thereby determined. For example, FIG. 3 shows an example of the relationship between the concentration (vol %) corresponding to the carbon potential of the carburizing gas (methane), the carburizing time (minutes), and the surface carbon concentration (wt %) until the surface carbon concentration of the treatment object reaches the solid solubility limit (1.15 wt %) at a carburizing temperature of 1,300° C. In FIG. 3, when the carburizing gas concentration is 3 vol %, the surface carbon concentration of the treatment object changes as shown by the solid line L1 in the diagram and reaches the solid solubility limit in a carburizing time of about 10 minutes; when the carburizing gas concentration is 4 vol %, the surface carbon concentration of the treatment object changes as shown by the solid line L2 in the diagram and reaches the solid solubility limit in a carburizing time of about 5 minutes; when the carburizing gas concentration is 7 vol %, the surface carbon concentration of the treatment object changes as shown by the solid line L3 in the diagram and reaches the solid solubility limit in a carburizing time of about 2 minutes; and when the carburizing gas concentration is 10 vol %, the surface carbon concentration of the treatment object changes as shown by the solid line L4 in the diagram and reaches the solid solubility limit in a carburizing time of about 1 minute.

Figure 4:
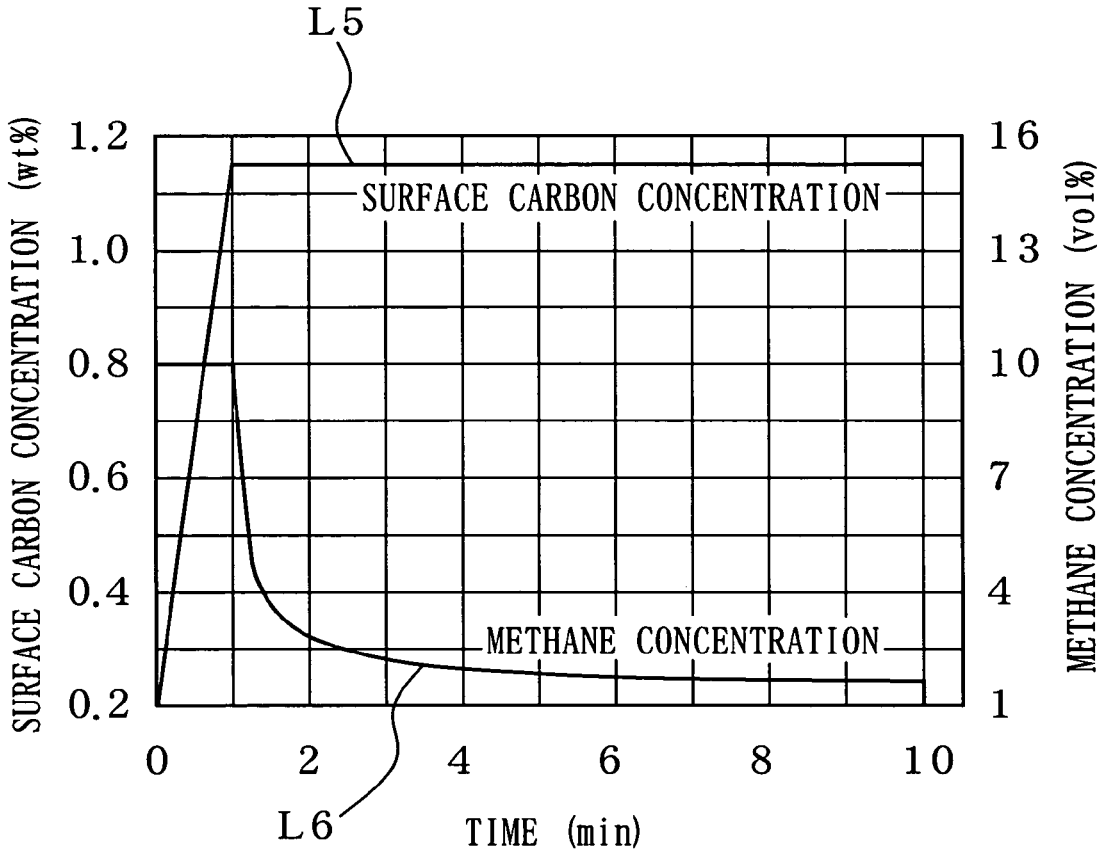
FIG. 4 is a diagram showing a relationship between the surface carbon concentration of the treatment object and the carburizing time and the relationship between the carburizing time and the carburizing gas concentration required for keeping the surface carbon concentration at a final target value in the embodiment of the present invention.
Figure 5:
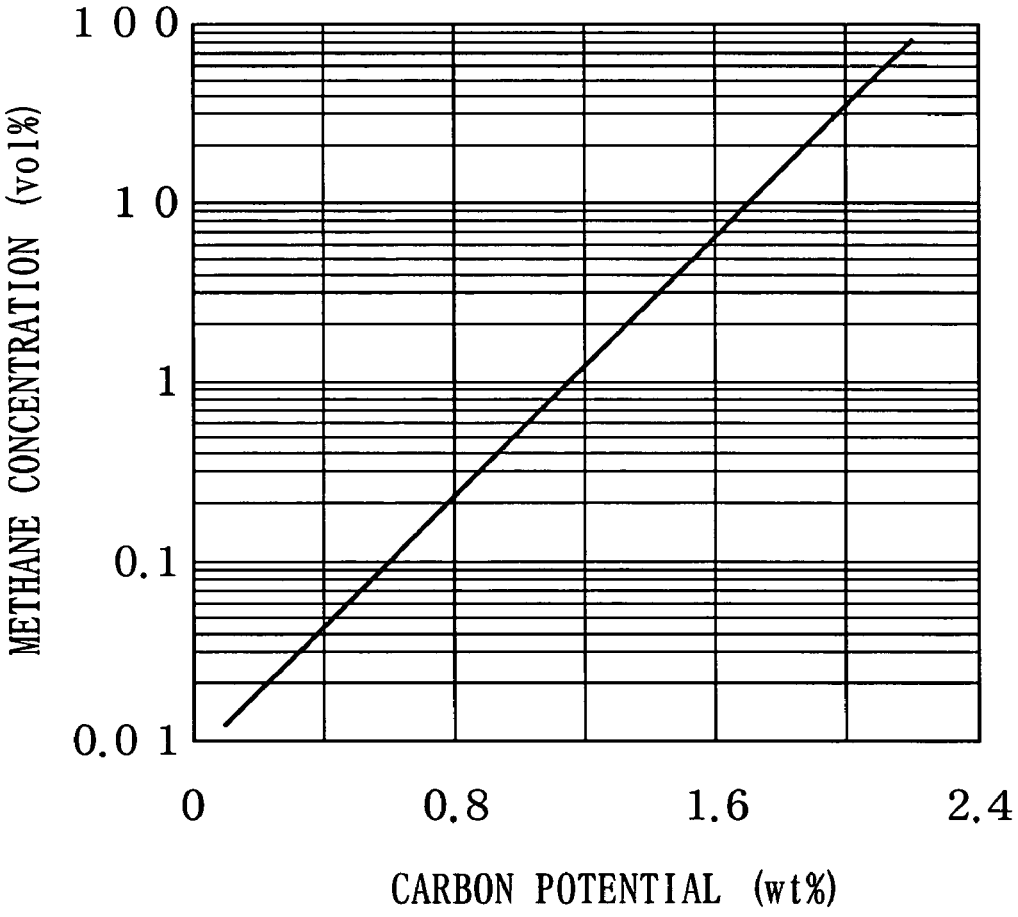
FIG. 5 is a diagram showing a relationship between the concentration of the carburizing gas and the carbon potential of the carburizing gas.

If the carburizing temperature is constant, the diffusion flux of the carbon atoms at the surface of the treatment object is proportional to the difference that is determined by subtracting the surface carbon concentration of the treatment object from the carbon potential of the carburizing gas. Hence the relationship between time and the carbon potential required to keep the surface carbon concentration of the treatment object at the final target value with the carburizing temperature being kept at a constant value can be determined by determining the relationship between time and the diffusion flux of the carbon atoms when the surface carbon concentration of the treatment object is at the final target value. Because the diffusion flux of the carbon atoms is proportional to the difference that is determined by subtracting the solid solubility limit of the carbon at the surface of the treatment object from the carbon potential of the carburizing gas, the relationship between time and the diffusion flux of the carbon atoms can be determined from a known relational expression or experiments; and it is reported, for example, in an article titled Engineering Concepts by Dave Van Aken in the issue of Industrial Heating on May 1, 2000, that an approximate value can be easily determined by using a spreadsheet software and a known expression. For example, the relationship between time and the diffusion flux of the carbon atoms at the surface of the sample 5' is determined when the carburizing temperature is 1,300° C. and the surface carbon concentration of the sample 5' is equal to the solid solubility limit of 1.15 wt %, which is the final target value. The relationship between time and the carbon potential required to keep the surface carbon concentration of the treatment object at the solid solubility limit which is the final target value at a constant carburizing temperature is thereafter determined from the known solid solubility limit and the determined relationship between time and the diffusion flux. In FIG. 4, the solid line L5 shows the relationship between the surface carbon concentration (wt %) of the treatment object and carburizing time; and the solid line L6 shows the relationship between time (minutes) and the concentration (vol %) of the carburizing gas that corresponds to the carbon potential of the carburizing gas required to keep the surface carbon concentration at the solid solubility limit (1.15 wt %) which is the final target value. The relationship between the concentration (vol %) of the carburizing gas and the carbon potential of the carburizing gas can be predetermined by experiments, because the surface carbon concentration of the treatment object corresponds to the carbon potential if the concentration of the carburizing gas is kept constant and carburization is performed over a long period of time. FIG. 5 shows an example of the relationship between the concentration of the carburizing gas (vol %) and the carbon potential (wt %), in which the relationship is determined by experiments.

Figure 1:
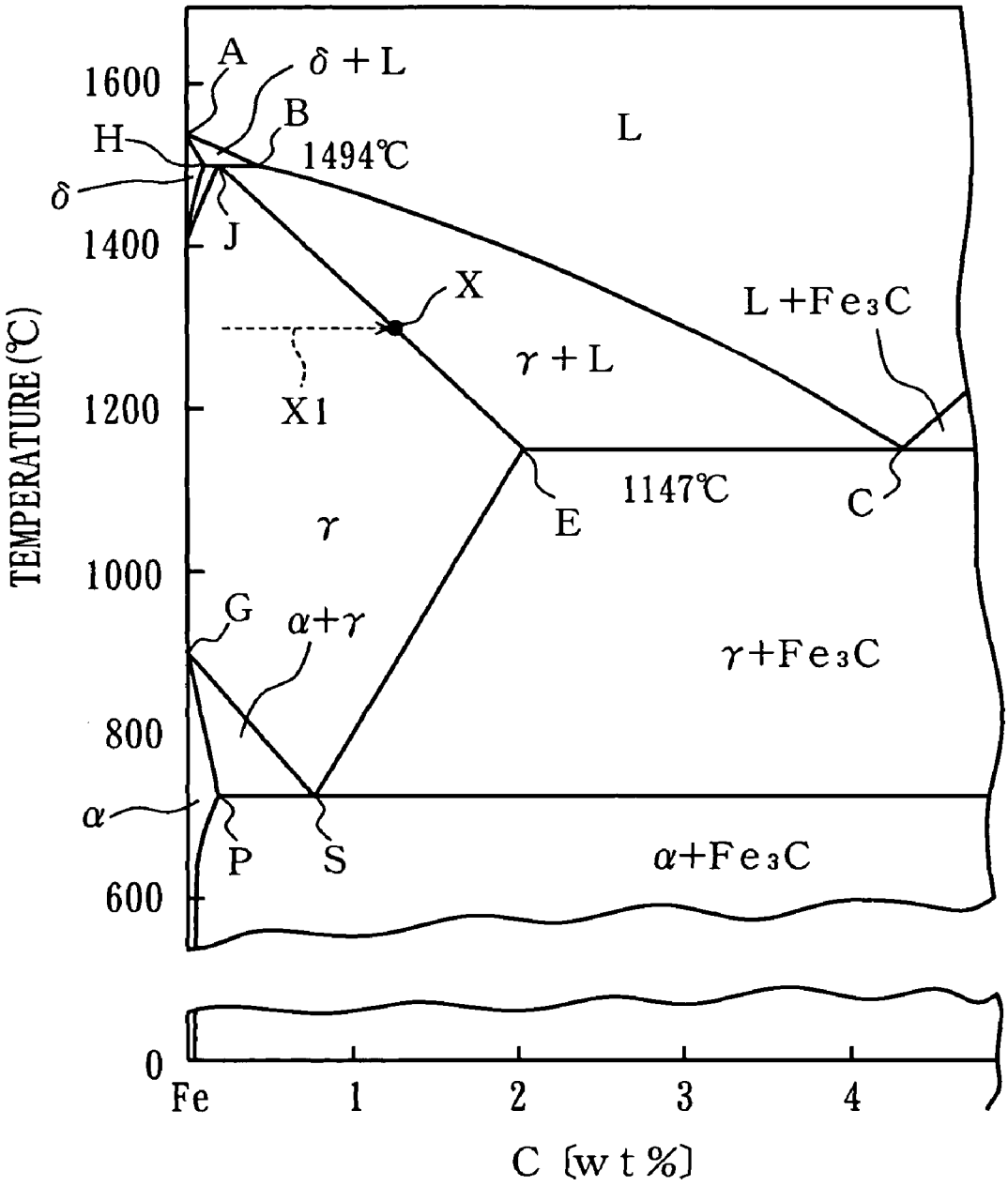
FIG. 1 is an iron-carbon equilibrium diagram.
Figure 6:
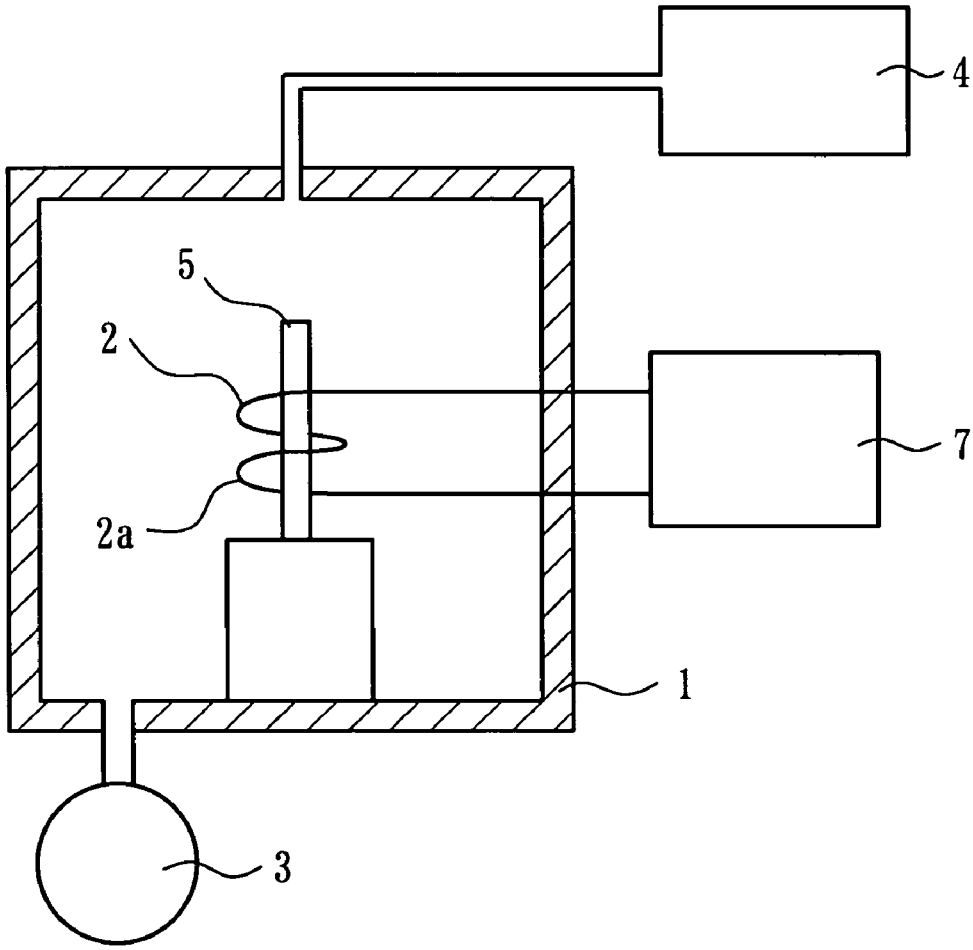
FIG. 6 is a diagram showing a state in which a treatment object is heated by the gas carburizing apparatus of the embodiment of the present invention.

After the relationships shown in FIGS. 3 and 4 are predetermined by gas carburizing the sample 5', a steel treatment object is gas carburized by using the gas carburizing apparatus. Carburization of the treatment object can be carried out in the same manner as carburization of the sample 5'. To be more precise, the treatment object 5 is set in the heating device 2 as shown in FIG. 6, the air within the vacuum container 1 is exhausted by means of the vacuum pump 3, gas for the carburizing atmosphere is introduced from the gas source 4 to the vacuum container 1 to pressurize the carburizing atmosphere to a set pressure, and the gas for the carburizing atmosphere is exhausted at a constant flow rate by means of the vacuum pump 3 while being fed at a constant flow rate from the gas source 4 to the vacuum container 1. The carburizing gas concentration that corresponds to the carbon potential of the carburizing gas within the vacuum container 1 is thereby set to a constant value. The carburizing temperature of the treatment object 5 is set to a constant value, which is not higher than the peritectic point, at which steel transforms from δ iron and liquid phase to γ iron, and is not less than the eutectic point, at which steel transforms from liquid phase to γ iron and cementite, by means of the heating device 2. A first step for heating the treatment object 5 in the carburizing atmosphere comprising the carburizing gas is carried out for a set time at the set carburizing gas concentration and carburizing temperature until the surface carbon concentration of the treatment object 5 reaches the final target value that is not higher than the solid solubility limit. In this first step, the carburizing temperature, the carburizing gas concentration that corresponds to the carbon potential of the carburizing gas, and the carburizing time until the surface carbon concentration of the treatment object 5 reaches the final target value are set so as to satisfy the predetermined relationship shown in FIG. 3. In the present embodiment, the final target value of the surface carbon concentration of the treatment object 5 corresponds to the solid solubility limit (1.15 wt %), the carburizing temperature is set to 1,300° C., the carburizing gas (methane gas) concentration is set to 10 vol %, and the carburizing time is set to one minute in the first step. As a result, the surface carbon concentration of the treatment object 5 changes as indicated by the dashed line with an arrow X1 in FIG. 1 and rapidly reaches the vicinity of point X that indicates the solid solubility limit on the line JE.

After the above described first step, a second step for advancing gas carburization is carried out by reducing the carbon potential of the carburizing gas with the lapse of time so that the carburizing depth of the treatment object 5 increases while the surface carbon concentration of the treatment object 5 is kept at the final target value corresponding to the solid solubility limit. The carbon potential of the carburizing gas is reduced by reducing the concentration of the carburizing gas. In the second step, the carbon potential of the carburizing gas is varied with respect to time so as to satisfy the predetermined relationship while the carburizing temperature is kept at a constant value. In the present embodiment, the concentration (vol %) of the carburizing gas is reduced with the lapse of time so as to satisfy the relationship indicated by the solid line L6 in FIG. 4, in order to keep the surface carbon concentration of the treatment object 5 at the solid solubility limit (1.15 wt %) which is the final target value, while the carburizing temperature is kept at 1,300° C. As a result, the carburizing temperature and the carbon potential of the carburizing gas in the first step are kept constant, the constant carburizing temperature in the second step is kept equal to the constant carburizing temperature in the first step, and the initial carbon potential of the carburizing gas in the second step is set equal to the constant carbon potential in the first step.

Figure 7:
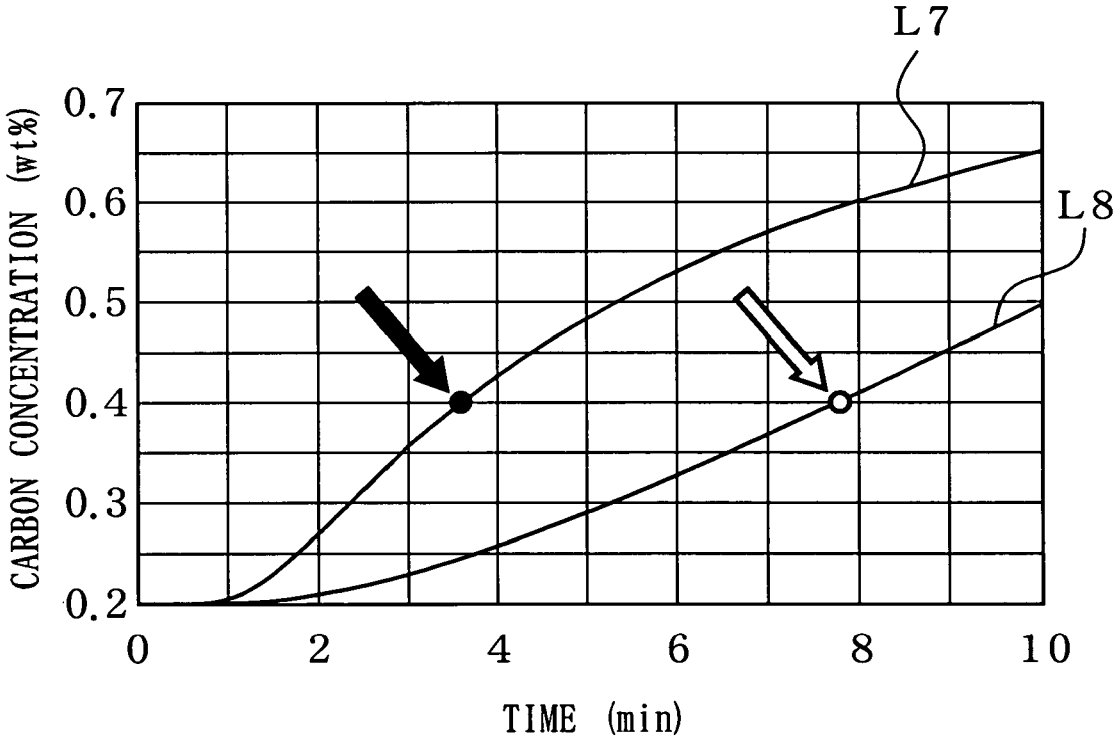
FIG. 7 is a diagram showing relationships between the time and the carbon concentration of the treatment object in a conventional example and the embodiment of the present invention.

The solid line L7 in FIG. 7 shows the relationship between the carburizing time and the carbon concentration at a position of 0.5 mm from the surface of a treatment object 5 on which gas carburization has been performed according to the method in the above-described embodiment of the present invention. The solid line L8 in FIG. 7 shows the relationship between the carburizing time and the carbon concentration at a position of 0.5 mm from the surface of a treatment object 5 on which gas carburization has been performed according to a conventional method; in this conventional example, the carburizing temperature was set to 1,300° C., the concentration (vol %) corresponding to the carbon potential of the carburizing gas was set to 3 vol %, and these were kept constant throughout the entire carburizing time. It is apparent from FIG. 7 that the time until the carbon concentration reaches 0.4 wt % at a position of 0.5 mm from the surface of the treatment object 5 is about 3.6 minutes according to the method in the above-described embodiment, and about 7.8 minutes according to the conventional method. In other words, it can be confirmed by calculation that the carburizing time according to the method in the above-described embodiment can be shortened by about 50%.

The present invention is not limited to the above-described embodiment, and modifications can be made within the scope of the present invention. For example, the method for varying the carbon potential of the carburizing gas is not limited to one that is performed by varying the concentration of the carburizing gas in the carburizing atmosphere, and the carbon potential may also be varied by admixing carburizing gas having a different number of carbon atoms into the carburizing atmosphere.

What is claimed is:

1. A method of rapid gas carburizing, using a carburizing atmosphere composed of an admixture of a hydrocarbon-based gas as a carburizing gas and a diluting gas, comprising:

a. first step in which a steel treatment object is heated in the carburizing atmosphere, the carburizing atmosphere having a constant, predetermined carbon potential set to a constant value by setting the flow rate of the carburizing atmosphere to a constant value and setting the concentration of the carburizing gas to a constant value, the first step continuing until a surface carbon concentration of the treatment object reaches a final target value that is not higher than a solid solubility limit at a carburizing temperature that is not higher than the peritectic point, at which steel transforms from δ iron and liquid phase to γ iron, and is not less than the eutectic point, at which steel transforms from liquid phase to γ iron and cementite, the solid solubility limit existing on a solidus line, JE, of γ iron in an iron-carbon phase equilibrium diagram; and a second step in which the gas carburization at a carburizing temperature not higher than the peritectic point and not less than the eutectic point is advanced after the first step so that a carburizing depth of the treatment object increases while the surface carbon concentration of the treatment object is kept at the final target value by reducing a carbon potential of the carburizing gas over time at a rate-of-reduction, the rate-of-reduction of the carbon potential being decreased at a rate that decreases over time.

2. The method of gas carburizing according to claim 1, wherein a carburizing time until just before the melting of the surface of the object is predetermined by setting the carburizing temperature to a preset temperature.

3. The method of claim 1 wherein the carburizing temperature is not higher than the peritectic point and not less than 1,300° C.

4. The method of gas carburizing according to claim 1, wherein a relationship in the first step between the carburizing time until the surface carbon concentration of the treatment object reaches the final target value, the constant, predetermined carbon potential of the carburizing gas, and the carburizing temperature is predetermined;

the carburizing time until the surface carbon concentration of the treatment object reaches the final target value, the constant, predetermined carbon potential of the carburizing gas, and the carburizing temperature satisfy the predetermined relationship in the first step;

the carburizing temperature is kept constant in the first step and the second step;

the constant carburizing temperature in the second step is kept equal to the constant carburizing temperature in the first step; and an initial carbon potential of the carburizing gas in the second step is set equal to the constant, predetermined carbon potential of the carburizing gas in the first step.

5. The method of gas carburizing according to claim 4, wherein the final target value of the surface carbon concentration of the treatment object is set in order to correspond to the solid solubility limit of the carbon in the surface of the treatment object.

6. The method of gas carburizing according to claim 5, wherein the carburizing time until the surface carbon concentration of the treatment object reaches the final target value is predetermined by setting the carburizing temperature to a preset temperature.

7. The method of gas carburizing according to claim 1, wherein the final target value of the surface carbon concentration of the treatment object is set in order to correspond to the solid solubility limit of the carbon in the surface of the treatment object.

8. The method of gas carburizing according to claim 7, wherein a carburizing time until just before the melting of the surface of the object is predetermined by setting the carburizing temperature to a preset temperature.

9. The method of gas carburizing according to claim 1, wherein a relationship in the second step between the carburizing time and the carbon potential ofthe carburizing gas is predetermined, in which the relationship is required for keeping the surface carbon concentration of the treatment object at the final target value while the carburizing temperature is kept at a constant value; and the carbon potential of the carburizing gas is varied with respect to the carburizing time so as to satisfy the predetermined relationship while the carburizing temperature is kept at a constant value in the second step.

10. The method of gas carburizing according to claim 9, wherein the final target value of the surface carbon concentration of the treatment object is set in order to correspond to the solid solubility limit of the carbon in the surface of the treatment object.

11. The method of gas carburizing according to claim 9, wherein a relationship in the first step between the carburizing time until the surface carbon concentration of the treatment object reaches the final target value, the constant, predetermined carbon potential of the carburizing gas, and the carburizing temperature is predetermined;

the carburizing time until the surface carbon concentration of the treatment object reaches the final target value, the constant, predetermined carbon potential of the carburizing gas, and the carburizing temperature are set so as to satisfy the predetermined relationship in the first step;

the carburizing temperature is kept constant in the first step and the second step;

the constant carburizing temperature in the second step is kept equal to the constant carburizing temperature in the first step; and an initial carbon potential of the carburizing gas in the second step is set equal to the constant, predetermined carbon potential of the carburizing gas in the first step.

12. The method of gas carburizing according to claim 11, wherein the final target value of the surface carbon concentration of the treatment object is set in order to correspond to the solid solubility limit of the carbon in the surface of the treatment object.

13. The method of gas carburizing according to claim 12, wherein the carburizing time until the surface carbon concentration of the treatment object reaches the final target value is predetermined by setting the carburizing temperature to a preset temperature.

* * * * *